United States Patent [19]

Struckmann

[11] 4,340,359

[45] Jul. 20, 1982

[54] APPARATUS AND METHOD OF HEATING PARTICULATE MATERIAL

[76] Inventor: Holger Struckmann, 104 S. Alward Ave., Basking Ridge, N.J. 07920

[21] Appl. No.: 224,030

[22] Filed: Jan. 12, 1981

Related U.S. Application Data

[62] Division of Ser. No. 8,268, Feb. 1, 1979, Pat. No. 4,266,931.

[51] Int. Cl.[3] ..... F21B 15/00

[52] U.S. Cl. ..... 432/14; 432/17

[58] Field of Search ..... 432/14, 15, 17, 118

[56] References Cited

U.S. PATENT DOCUMENTS

| | | | |
|---|---|---|---|
| 1,216,667 | 2/1917 | Downs | 432/14 |
| 3,822,651 | 7/1974 | Harris et al. | 110/246 |
| 4,055,390 | 10/1977 | Young | 432/14 |
| 4,259,081 | 3/1981 | Reuter et al. | 432/14 |

*Primary Examiner*—John J. Camby

*Attorney, Agent, or Firm*—Kenyon & Kenyon

[57] ABSTRACT

The rotary combustion bed has a rotary drum with a permeable refractory lining through which air is blown during rotation of the drum and cascading of a charge of material in the drum. The air may flow upwardly through the material at a predetermined fixed angle over an angle through which air is blown into the charge.

8 Claims, 7 Drawing Figures

APPARATUS AND METHOD OF HEATING PARTICULATE MATERIAL

This is a division of application Ser. No. 8,268, filed Feb. 1, 1979, now U.S. Pat. No. 4,266,931.

This invention relates to an apparatus and method for heating particulate material and, more particularly, to a rotary combustion bed and heat recuperator.

Heretofore, it has been known to use a rotary kiln to treat material in a heated condition. One of the principal advantages of a rotary kiln is the ability to mechanically tumble, mix, cascade and gently churn the material being treated. This churning ability enables the kiln to handle somewhat sticky materials such as cement raw material, which must be heated to the point of incipient fusion for clinkering. Another advantage of mechanical mixing is the prevention of very wide temperature differences within the cross-section of a load.

However, one of the principal disadvantages of the rotary kiln has hitherto been the low heat transfer rate which occurs in the combustion zone in that combustion takes place above the material being treated. The hottest gases cannot be made to flow through the material as in the shaft kiln. While the load receives heat directly from the hot gases sweeping over the surface of the material, a great deal of heat is received from the kiln lining which has greater contact with the gases. Actually, the heat transfer area per unit of kiln length is, in effect, quite limited and therefore unsuited for a high heat transfer rate. This is especially true when compared with the surface area available in a bed of material particles per unit of kiln length. The result, for example, is that during one kiln revolution with a combustion gas temperature of 3,340° F. and a material temperature of 1,679° F., the temperature of the hot face of the lining can fluctuate from 2,759° F. just before entering under the load to 2,192° F. upon coming out from under the load. Thus, a temperature fluctuation of 567° F. per revolution would be obtained.

Further, the higher the temperature of the face of the kiln lining, the higher would be the temperature of the shell forming the kiln and thus the higher the heat loss. Not only is this wasteful but can also be structurally dangerous to the kiln.

It is well known that many particulate materials can be heated or burned in stationary furnaces so designed as to suspend or envelope each of the closely spaced particles of material in an upward flow of gas which can give the material the characters of being fluid. However, if the hot gas flow is not uniform throughout every unit of area of the combustion zone, some of the material will lose its fluidity while other material may become more lively. Under such circumstances the material will not receive uniform treatment.

Accordingly, it is an object of this invention to provide an apparatus for heating and/or burning particulate material wherein heating and/or burning may take place in the voids between the particles of the material.

It is another object of the invention to permit combustion to take place in the voids between the particles of a particulate material without the need to fluidize or suspend the material in hot combustion gases.

It is another object of the invention to provide an apparatus wherein combustion may take place in a bed of particulate material while the material is churned and mixed mechanically.

It is another object of the invention to recuperate some of the heat which would normally be lost within a combustion chamber during heating of a particulate material.

It is another object of the invention to reduce the heat required for the burning or processing of particulate material.

Briefly, the invention provides an apparatus and method for heating and/or burning particulate material while churning or cascading the material.

One apparatus of the invention includes a rotary combustion bed which is comprised of a rotary drum disposed on a horizontal longitudinal axis and defining a chamber to receive and cascade a charge of material, a permeable refractory lining about the chamber of the drum to receive a cascading charge of material and means for passing a flow of combustion air through the lining into the chamber and into the cascading charge of material during rotation of the drum.

In addition, means are provided for passing ingredients required for combustion into the cascading charge of material in the combustion chamber.

In one embodiment, the drum is constructed of a perforated inner shell, an outer shell and a plurality of spacer plates secured to and between the shells to space the shells from each other. These plates include solid plates which define air distribution passages longitudinally of the axis of the shells and perforated plates interspaced with the solid plates. In addition, the means for passing a flow of air through the lining includes a blower in communication with a selective number of the passageways so as to blow the air through the passageways and thence through the perforated inner shell into the chamber over a given angle of blow.

In this embodiment, the outer shell has a plurality of circumferentially disposed slots in communication with the longitudinal passageways and a belt disposed circumferentially about the drum to seal the slots. In addition, a take-up pulley is positioned in spaced relation to the drum and has the belt entrained thereon. The take-up pulley thus allows a space to be formed to communicate a number of slots in the drum with the blower. The pulley is also utilized to hold the belt against the drum. During rotation, the belt seals the slots except for a selective number of slots which are exposed to the blower so that the blown air can pass directly through the slots into the adjacent longitudinal chambers.

In order to facilitate passage of the air through the permeable lining of the drum, the lining may be made of kiln bricks wherein each has grooves which communicate at least one of the passageways in the drum with the combustion chamber. Alternatively, the lining may be made of blocks, each of which is formed of a fire brick having at least a porous ceramic side and a porous ceramic base for passing the air therethrough or the lining can be completely porous.

In addition, the rotary combustion chamber has a means for adjusting the angle of blow as well as the angle at which the flow of air is passed through the lining into the combustion chamber. This means includes a pair of pulleys which are disposed on opposite sides of the take-up pulley and over which the belt is entrained. The two pulleys are adjustable relative to each other so as to regulate the air flow passing through the slots in the outer shell. In this regard, by moving the pulleys closer together, the number of slots exposed to the passage of air can be reduced. This, in turn, reduces the angle of blow. Alternatively, by moving the pair of pulleys apart, the number of exposed slots is increased and the angle of blow is increased. In order to change the location of the angle of blow, one or both pulleys may be moved in one direction relative to the take-up pulley.

The method of the invention includes the steps of placing a charge of particulate material in a rotary drum having a horizontally disposed longitudinal axis, rotating the drum about the axis to displace the charge of material towards one side while disposing the charge in a bed with a surface defining an angle to a horizontal plane and while cascading the material within the bed, and passing a flow of air upwardly through the charge of material during rotation of the drum.

In addition to introducing air into the bed of particulate material, a charge of fuel may also be delivered to the rotating drum to effect combustion in the bed of material. In addition, materials such as limestone and/or dolomite may also be introduced into the charge of material in order to control the type of combustion gases produced if, for example, the fuel should be of a non-compliance type.

During operation, the air is passed through the permeable refractory lining in the drum while the material cascades along the lining. This provides a combined mixing and heating effect.

These and other objects and advantages of the invention will become more apparent from the following detailed description taken in conjunction with the accompanying drawings wherein.

Figure 1:
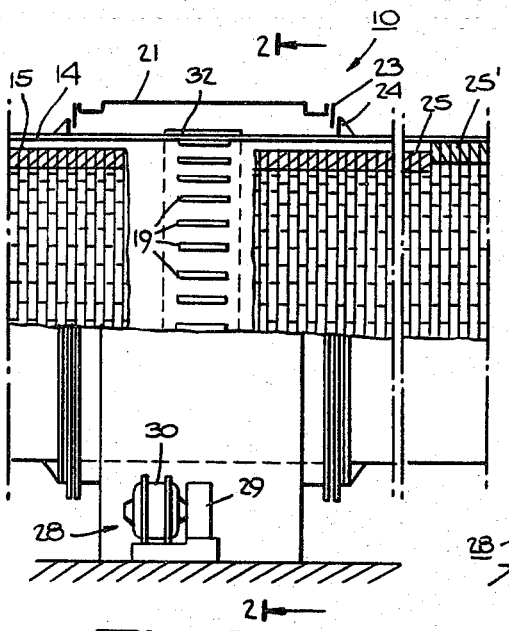
FIG. 1 illustrates a part sectional view of a rotary combustion bed constructed in accordance with the invention.

Referring to FIG. 1, the rotary combustion bed and heat recuperator 10 is constructed in a manner somewhat similar to a conventional cement kiln. As shown, the rotary combustion bed 10 includes a rotary drum 11 which is disposed on a horizontal longitudinal axis and defines a combustion chamber 12 to receive a charge of particulate material 13. The drum 11 is driven by suitable means (not shown) to rotate in a counter-clockwise manner as viewed in FIG. 2.

Figure 3:
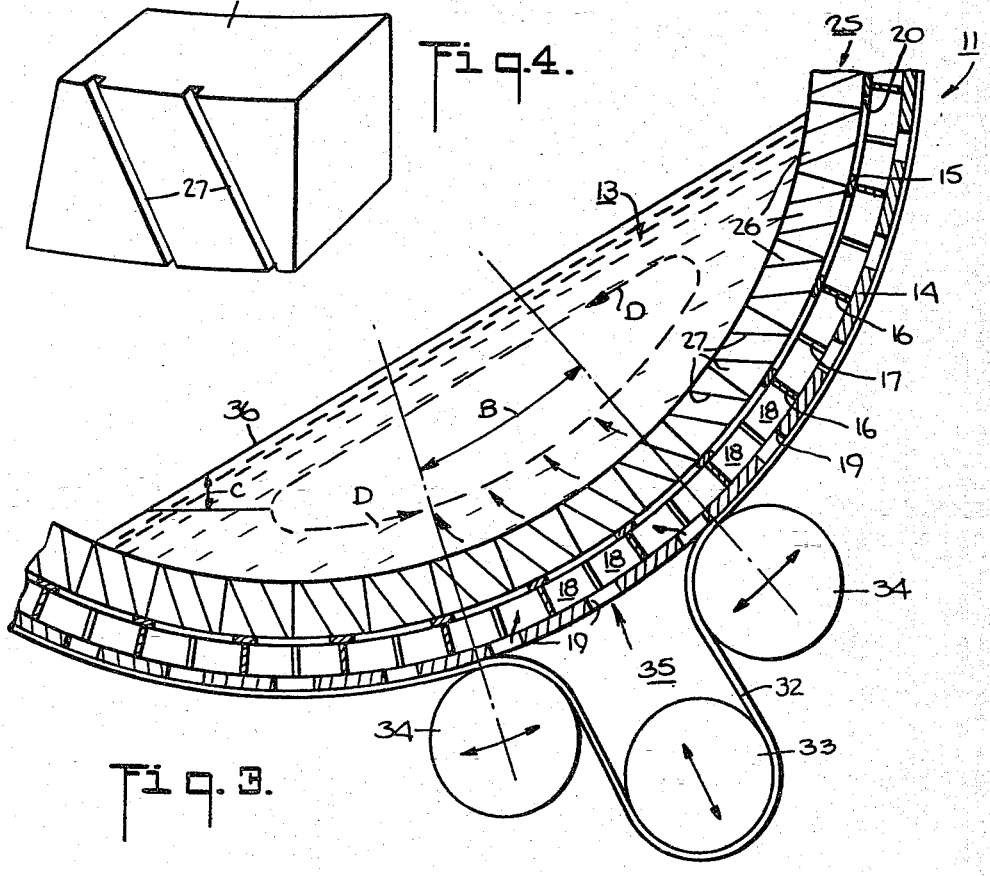
FIG. 3 illustrates an enlarged detail of a means for adjusting the angle of blow in accordance with the invention.

Referring to FIG. 3, the drum 11 has an outer shell 14 and an inner shell 15 which are spaced apart by a plurality of circumferentially spaced spacer plates 16, 17 made of flat iron. These plates 16, 17 alternate with each other and are secured to and between the shells 14, 15 in order to space the shells from each other. In addition, alternating plates 16 are solid to limit tangential flow of air and define air distribution passageways longitudinally of the axis of the drum 11. The other plates 17 are perforated to provide a communication between adjacent chambers 18. In addition, the outer shell 14 includes a plurality of circumferentially disposed slots 19. Each slot 19 is aligned with a perforated plate 17 so as to communicate with a pair of chambers 18. Likewise, the inner shell 15 is perforated with a plurality of slots 20 in communication with the chambers 18.

Referring to FIG. 1, a hood 21 encompasses the drum 11 in sealed relation about the shell sections in which the slots 19, 20 are located to define an enclosed chamber 22 about the drum 11. To this end, the hood 21 is sealed at each end by flexible stationary sealing rings 23 which are held against revolving sealing members 24 rigidly attached to the shell 14.

Figure 4:
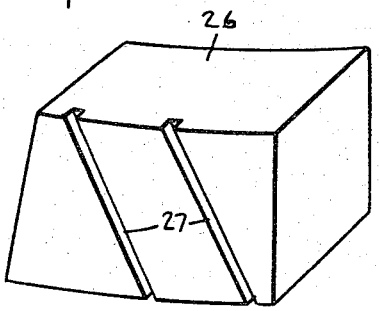
FIG. 4 illustrates a perspective view of one type of fire brick utilized in the rotary combustion bed of FIG. 1 in accordance with the invention.

Referring to FIG. 4, a permeable refractory lining 25 lines the chamber 12 on the inside of the inner perforated shell 15 while a non-permeable lining 25′ lines the remainder of the drum 11. The permeable lining 25 is made up of a plurality of kiln bricks 26 with the bricks in the area of the slots 20 having a pair of grooves 27 at least in one surface which is perpendicular to the axis of the drum 11. As indicated, these grooves 27 communicate with the passageways 18 via the slots 20 in the shell 15 and may be formed by ceramic saw cuts so angled that, as the kiln rotates, material falls away from the cuts.

Figure 2:
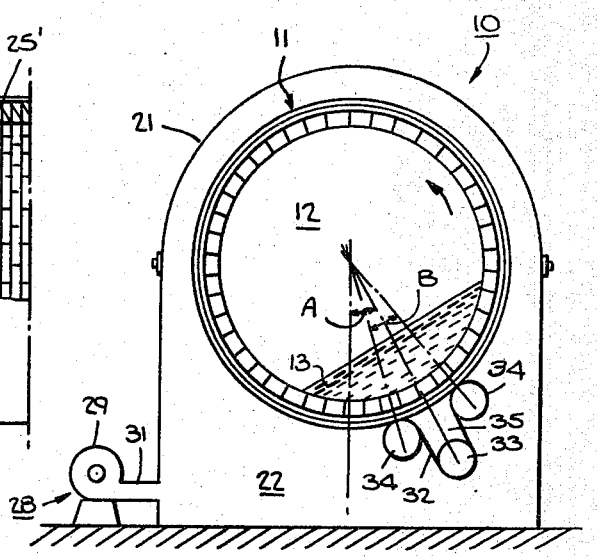
FIG. 2 illustrates a cross-sectional view taken on line 2—2 of FIG. 1.

As shown in FIGS. 1 and 2, a means for passing a flow of air through the lining 25 is provided. This means 28 includes a blower 29 and a variable speed blower drive motor 30 outside the hood 21. The blower 29 has an outlet 31 which is connected with the hood 21 to communicate the blower 29 with the enclosed chamber 22. Thus, upon actuation of the blower 29, a flow of air is discharged into the chamber 22.

Referring to FIGS. 2 and 3, a means such as a belt 32 is circumferentially disposed about outer shell 14 of the drum 11 in order to seal the slots 19. This belt 32 is entrained about a takeup pulley 33 spaced from the drum 11 as well as over a pair of adjustable pulleys 34. The pulleys 33, 34 are arranged so that the belt 32 forms a space 35 whereby air may pass from the chamber 22 via the slots 19 into the distribution passageways 18 of the drum 11. The take-up pulley 33 serves to hold the belt 32 in a taut manner against the drum 11 to effectively seal off the slots 19 through which air is not to be directed.

As shown, the pulleys 34 are disposed laterally of a vertical plane passing centrally through the drum 11 in order to effect an inflow of air into the drum 11 at a predetermined angle A and over an angle of blow B.

The pulleys 34 are adjustable towards and away from each other individually or in tandem so as to change the number of slots 19 which are in open communication with the space 35. These pulleys 34, thus, serve as a means for adjusting the volume of air blown into the chamber 12 per unit of area. In addition, the pulleys 34 serve as a means to adjust the circumferential angle A at which the air is blown into the chamber 12 as well as the angle of blow B.

The distribution chambers 18 which are exposed to the space 35 serve to distribute air upwardly into the bed of material 13 through the combustion zone of the drum 11.

During operation, the drum 11 is rotated while the blower 29 forces a flow of air into the chamber 22 defined by the hood 21. This air then passes through the space 35 afforded by the belt 32 and passes upwardly through the exposed slots 19 in the outer shell 14 into the air distribution passageways 18. The air then passes through the slots 20 in the inner shell 15 and, thence, through the fire brick grooves 27 which are in communication with those passageways 18. As indicated in FIG. 3, the air passes into the bed of material 13 within an angle of intense blow B which conforms generally to the angle between the two adjustable pulleys 34 relative to the axis of the drum 11. This air combined with the fuel or hot gases introduced into the drum 11 via suitable sources (not shown) then supports combustion within the bed of material 13 within the voids (not shown) between the particles of material. This combustion combines with the cascading action which takes place due to the rotation of the drum 11 wherein the material is churned in the directions indicated by the arrows D (FIG. 3) while being in a non-fluidized state. Thus, the material is not only subjected to combustion but also to cascading so that a relatively uniform heating of the material takes place throughout the bed.

As indicated in FIG. 3, the free surface 36 of the material bed 13 is disposed at angle equal to the angle of repose C of the material during rotation of the drum 11.

It is to be noted that the pressure created by the blower 29 holds the flexible seal rings 23 against the rigid sealing members 24 to allow for small longitudinal movements of the drum 11 as well as for some misalignment between the drum 11 and the hood 21. Other sealing arrangements may also be used, such as springs, gravitational weights, and the like.

The permeable or porous lining 25 will not be subjected to the same hot face temperature variations as would otherwise occur in a rotary kiln. To this end, the air which is directed from the air passageways 18, although somewhat preheated, is far below the flame temperature and serves to cool the fire brick 26 during passage through the grooves 27. Since this air is blown through the brick during the hottest part of the cycle (per one kiln revolution), the brick is cooled.

The air permeable fire bricks are therefore in contact largely with the coolest elements in the section because:

(a) the air leaving the inner surface of the brick which is under the section of the bed in which combustion is taking place is not likely to instantly attain the highest combustion temperature;

(b) the lining is quickly placed in contact with cooler material as the drum 11 revolves to prevent heat build up should the air reach a high temperature; and (c) the combustion gases which leave the bed, through which they are passed, are of the same temperature or close thereto as the material in the bed. In this case, the brick over the bed (the area of no blow) are not subjected to the hottest combustion gases.

Figure 6:
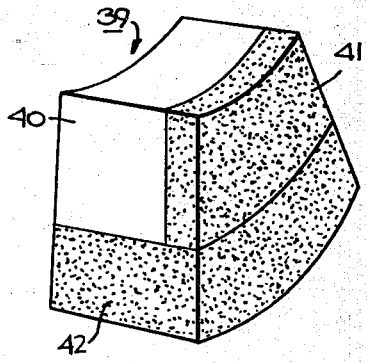
FIG. 6 illustrates a perspective view of an alternative block construction utilized in a permeable lining in accordance with the invention.

Alternatively, instead of providing grooves in the fire brick 26 alternative modifications may be made. For example, as shown in FIG. 6, the permeable refractory lining 25 may be made of blocks 39 each of which is composed of an impervious fire brick 40 bonded with a porous ceramic side 41 and a porous ceramic base 42.

If there should be a danger of "backflow" in a highly fluidized bed away from the angle of intense blow, grooves such as those shown in FIG. 4 can be filled with a rather coarse grained, uniformly sized refractory material bonded by refractory cement. This will serve to seal off the grooves from "backflow". Other permeable materials, such as refractory fibers, can also be used to seal off the grooves from a "backflow".

Liners of suitable porosity can also be made from discarded fire brick, suitable for the region to be lined, after the old liners have been cleaned of all extraneous material crushed, screened and graded through limited size range, before being recast with refractory cement in a comparatively dry mix. Built-up blocks such as shown in FIG. 6 can also be used to give a more concentrated air flow, that is, a smaller area may be used to discharge the same volume of air.

Further, orifices and sintered plates and the like can also be used to prevent backflow as is done, for example, in stationary furnaces for fluidized bed combustion. Finally, a restricted air flow just sufficient to prevent backflow may also be provided under the part of the bed that is not in the angle of intense blow B.

Further, solid fuel or other ingredients required for combustion may be charged into the cascading bed of material 13 by several means. For example, the fuel may be ground into the raw material, or mixed in as rather coarse particles with the material before charging into the drum 11 or injected into the bed 13 in the same manner as fuel is injected in fluidized combustion beds and stationary furnaces. Solid fuel may also be picked up by a circumferentially spiraling scoop (not shown) and as the kiln (or drum 11) rotates, be brought through the shell and lining to fall on and be mixed into the charge. Liquid or gaseous fuel may be piped onto the revolving kiln by a suitable means. For example, such means may include rotary unions which deliver the fluid fuel to high pressure pumps, injectors, timed release valves and/or nozzles all mounted on the kiln for injection into or onto the cascading charge Many materials will have different angles of repose when permeated with an air flow than when only subjected to the turning of the drum 11. In the illustrated embodiment, the angle of blow is about 30°.

Figure 5:
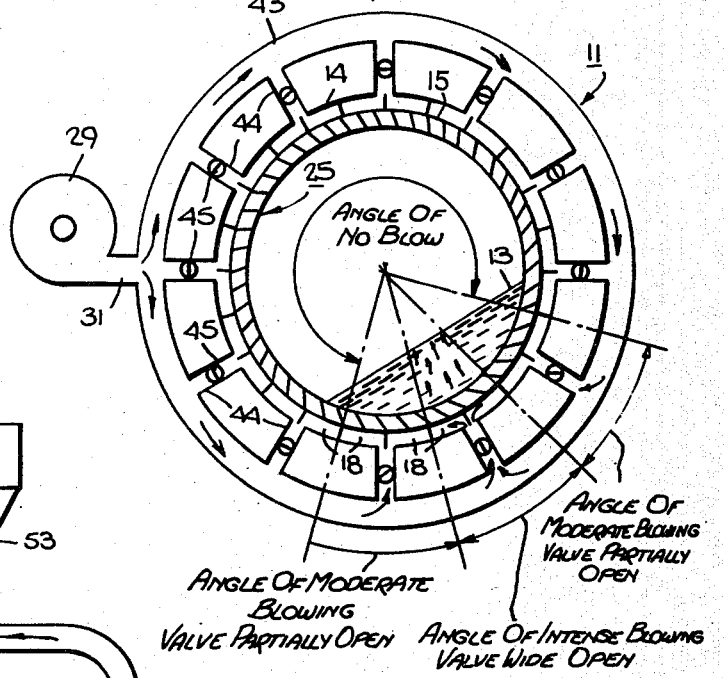
FIG. 5 illustrates an alternative means of supplying combustion air to a rotary combustion bed constructed in accordance with the invention.

Referring to FIG. 5, wherein like reference characters indicate like parts as above, another type of apparatus to produce the desired action may include a rotary combustion bed wherein the blower 29 and motor (not shown) are mounted on the drum outer shell 14. Power to the motor passes through encircling wires (not shown) which are also mounted on but insulated from the shell 14. Current for the wires can be fed through trolley wheels (not shown) in known manner. As shown, the drum 11 includes a manifold 43 which is disposed circumferentially outside the shell 14 and which communicates with the outlet of the blower 31 to receive an air flow. In addition, a plurality of circumferentially spaced ports 44 are connected between and to the manifold 43 and selected passageways 18 of the drum 11. In addition, a valve 45 is disposed in each port 44 for controlling the flow of air therethrough. In this embodiment, the blower 29 discharges air into the manifold 43 and the air is subsequently piped through the individual ports 44 via the automatically controlled valves 45 to the individual passageways 18 outside the lining 25. This embodiment eliminates the need for the hood, seal rings, sealing belt and pulleys of the embodiment shown in FIGS. 1–3.

As indicated in FIG. 5, the combustion air is blown upwardly into the bed of material 13 at a predetermined angle to the vertical and over a given angle of blow.

Figure 7:
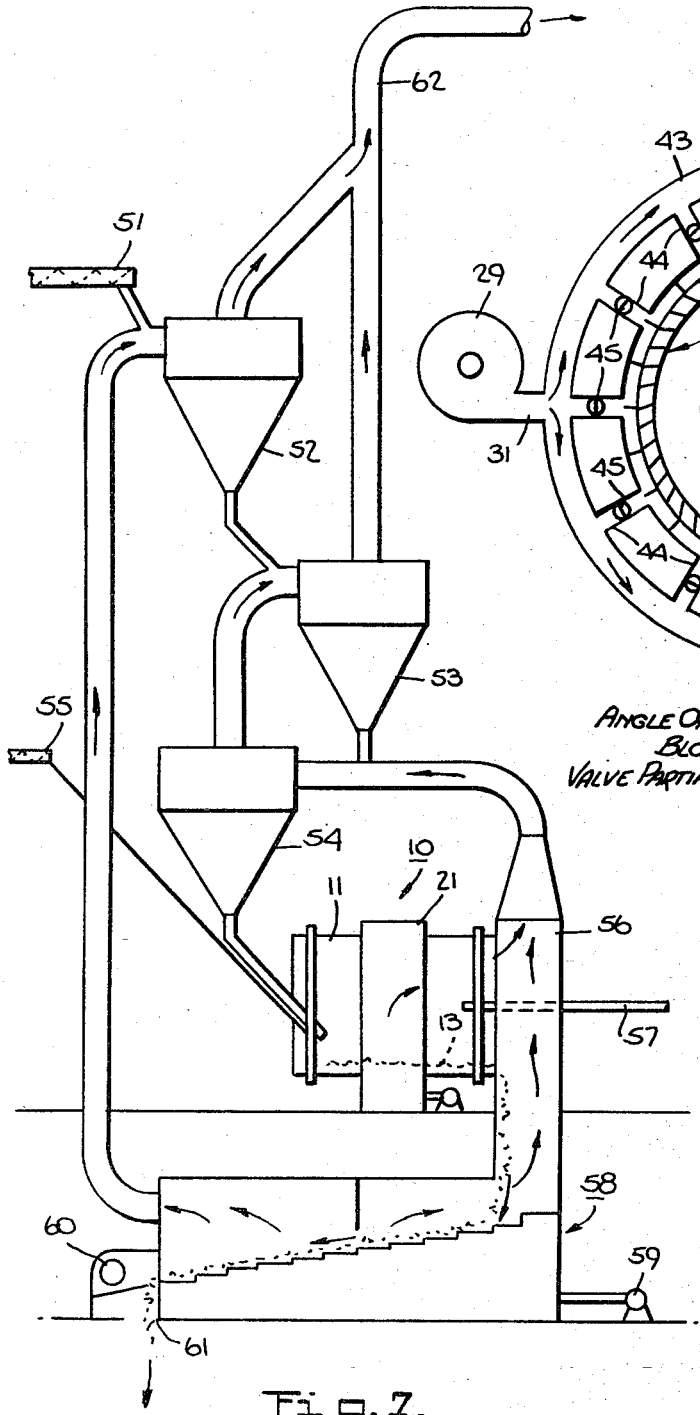
FIG. 7 illustrates a short rotary combustion bed kiln utilizing an apparatus in accordance with the invention.

The use of the rotary combustion bed in cement manufacture may well eliminate the need for long kilns or, if applied to existing kilns, should make the kilns more efficient for the same output capacity. The ability to transfer heat quickly and efficiently, in whatever stage of operation needing heat, can lead to a multiplicity of new constructions. For example, old kilns can be modernized for greater fuel efficiency and/or output and new installations can be constructed for short kilns, for example, as shown in FIG. 7. To this end, as shown in FIG. 7 a cement plant in which a burning operation takes place may be provided with a conveyor 51 for delivering raw material for combustion, a low temperature cyclone heat recuperator 52 which receives the raw material from the conveyor 51 and an intermediate temperature recuperator 53 for receiving heated material from the cyclone heat recuperator 52. In addition, a high heat recuperator 54 is disposed below the recuperator 53 to receive the heated material for passage into a kiln constructed in the manner of the rotary combustion bed 10 of FIGS. 1 and 2.

In addition, a solid fuel feeder 55 is provided to feed a solid fuel into one end of the drum 11 along with the raw material from the recuperator 54. The discharge end of the drum 11 is connected to a kiln hood 56 through which an auxiliary kiln burner pipe 57 passes into the drum 11. The material which exits from the drum 11 drops under gravity within the kiln hood 56 onto a two-stage grate cooler 58. This cooler 58 employs a blower 59 which blows cool air into the cooler 58 for cooling the material. A clinker crusher 60 is also provided with the cooler 58 in order to crush the material and to deliver the finished material through an outlet 61. As indicated, the exhaust gases from a first stage of the cooler 58 pass upwardly through the kiln hood 56 and join the exhaust gases of the kiln which then pass through the recuperators 54, 53 in heat exchange relation with the material to an outlet pipe 62. The pipe 62 may be connected, for example to a dust collector, draft fan and stack for elimination of the cooled exhaust gases.

The rotary combustion bed may also be adopted for use as a furnace for burning non-compliance fuels in the presence of lime-stone or dolomite at low combustion temperatures in order to reduce air pollution. The rotary combustion bed may also be adapted, by use of rotary unions, to inject gaseous or liquid fuels into the combustion bed. Also, by means of rotary unions, the combustion bed can process liquids or gases to be heated but which, either due to pressure or other reasons cannot be exposed directly to the combustion material or atmosphere.

The invention thus combines the benefits of combustion which takes place in the bed of materials to be treated, whether or not fluidized, with a churning and mixing of the material mechanically.

Further, in treating material which can be fluidized but need not be, for example for reasons of low heat release requirements or because there is no need for a fluid-like flow, the need to maintain a critical gas flow becomes unnecessary. In this case, a greater range in the flow of combustion air per unit of bed area becomes possible. Consequently, the fuel range and the corresponding heat release range can be larger. At the low end of the air flow range, there is less danger of channeling and uneven temperatures due to the constant mechanical mixing of the bed. At the high end of the air flow range, not only can the flow rate per unit of area be increased to the point of fluidity, but also the area of blow can be increased by increasing the angle of blow. Also, if needed, the bed can be constructed so as to increase the horizontal length of the drum available for blow.

The invention further provides a means of applying combustion in intimate contact within a bed of material so that the heat of combustion is radiated directly to the material and in such a manner as to be able to treat the material whether the particles are large or small and whether the bed is only subject to mechanical agitation or also fluidization.

Also, the invention allows the location of the angle of blow in a rotary drum to be adjusted to various angles of repose of the material being treated while in operation and/or in adjusting the size of the area of blow in response to process demands.

The invention provides a means creating a more uniform combustion bed temperature than is possible with a shaft kiln wherein relatively little movement or blending of the material can occur. The constant churning of the load prevents channelling of the gases regardless of the size of the particles in the load.

The invention allows a more uniform combustion bed temperature to be obtained than in a fluidized combustion bed in a stationary furnace where channelling, slugging, and large bubbles of combustion gas can hinder smooth operation because no extraneous forces exist to reduce or prevent them.

The invention further allows an increase in the life of a lining since the lining is not subjected to extreme temperature changes during each revolution of the drum.

The invention also provides an approximately horizontal cylindrical combustion chamber which rotates about its longitudinal axis so as to tumble and cascade a granular change within the voids of which the combustion of air and fuel takes place. The furnace is capable of being fueled by and/or burning sticky granular material without this material escaping from the combustion chamber to plug the air distribution and heat recuperating passages under the ceramic lining supporting the granular charge.

The furnace may also be used to transport process liquids or gases for treatment separately from the granular charge by means of rotary couplings centered on the longitudinal axis of the combustion chamber.

The invention further provides a potential for a higher "heat release or turn down range" than a conventional fluidized combustion bed operated in a stationary container. Due to the churning of the bed at low heat release, combustion air can be reduced to "banked" conditions without the danger of channeling and caking. Agitation of the bed is not dependent on air velocity. At the high release end of the range, the increased instability of any unblown material causes it to continuously slide into the blown area and upsetting uneven fluidization. The term "heat release range" is sometimes referred to as the "turn down range" or simply "the turn down". In the above description, it is taken to mean the extent that the furnace, after start up, can be kept in steady operation at either a low or a high heat release rate or at some rate in between.

Further it is to be noted that the fuel feeder 55 as shown in FIG. 7 might also be used as a means for injecting liquid or gaseous fuel into the drum 11.

What is claimed is:

1. A method of heat treating particulate material in a rotary drum, said method comprising the steps of placing a charge of particulate material in a rotary drum having a horizontally disposed longitudinal axis;

rotating the drum about said axis to displace the charge of material towards one side of said drum to dispose the charge in a bed with a surface defining an angle to a horizontal plane, while cascading the material within said bed; and passing a flow of air upwardly at a predetermined fixed angle to the vertical and over a selectively variable angle of blow into the charge of material during rotation of the drum.

2. A method as set forth in claim 1 wherein said angle of the material to a horizontal plane is equal to the angle of repose of the material.

3. A method as set forth in claim 1 wherein a charge of fuel delivered to the rotating drum to effect combustion in the bed of material.

4. A method as set forth in claim 1 which further comprises a step of blowing fuel upwardly into said bed of material for combustion of the material.

5. A method as set forth in claim 4 which further comprises the step of introducing one of limestone and dolomite into the charge of material for controlling combustion of the fuel.

6. A method as set forth in claim 1 wherein the flow of air is passed through a permeable refractory lining in the drum and the material cascades along the lining.

7. A method as set forth in claim 1 wherein said angle of blow is about 30°.

8. A method as set forth in claim 1 wherein said angle to the vertical is adjustable to various angles of repose of the material being treated and said angle of blow is adjustable in angular size in response to process demands.

* * * * *